US008499678B2

(12) United States Patent
Adam et al.

(10) Patent No.: US 8,499,678 B2
(45) Date of Patent: Aug. 6, 2013

(54) ARMORING ELEMENTS FOR A STRUCTURE, SUCH AS A MILITARY VEHICLE

(75) Inventors: Jean-Roch Adam, Vailly sur Sauldre (FR); Sophie Delaroche, Bourges (FR)

(73) Assignee: Nexter Munitions, Versailles (FR)

( * ) Notice: Subject to any disclaimer, the term of this patent is extended or adjusted under 35 U.S.C. 154(b) by 130 days.

(21) Appl. No.: 12/951,457

(22) Filed: Nov. 22, 2010

(65) Prior Publication Data

US 2011/0132183 A1 Jun. 9, 2011

(30) Foreign Application Priority Data

Dec. 4, 2009 (FR) ..... 09 05887

(51) Int. Cl.
*F41H 7/02* (2006.01)

(52) U.S. Cl.
USPC ..... 89/36.08; 89/36.01

(58) Field of Classification Search
USPC ..... 89/36.01, 36.02, 36.04, 36.07, 36.08, 89/36.09, 36.017
See application file for complete search history.

(56) References Cited

U.S. PATENT DOCUMENTS

| | | | | | |
|---|---|---|---|---|---|
| 1,508,421 | A | * | 9/1924 | Taegen | 109/83 |
| 3,765,299 | A | | 10/1973 | Pagano et al. | |
| 4,036,104 | A | | 7/1977 | Pagano et al. | |
| 4,325,283 | A | * | 4/1982 | Bemiss | 89/36.07 |
| 4,957,034 | A | * | 9/1990 | Tasdemiroglu | 89/36.02 |
| 5,398,592 | A | * | 3/1995 | Turner | 89/36.08 |
| 5,452,641 | A | * | 9/1995 | Kariya | 89/36.14 |
| 5,499,568 | A | * | 3/1996 | Turner | 89/36.08 |
| 5,670,734 | A | * | 9/1997 | Middione et al. | 89/36.08 |
| 5,718,434 | A | * | 2/1998 | Alward | 273/410 |
| 5,780,761 | A | * | 7/1998 | Musante et al. | 89/36.08 |
| 5,803,212 | A | * | 9/1998 | Reinehr et al. | 188/372 |
| 7,080,587 | B2 | * | 7/2006 | Benyami et al. | 89/36.08 |
| 7,370,567 | B2 | * | 5/2008 | Jones et al. | 89/36.02 |
| 7,546,795 | B1 | * | 6/2009 | Munson, Jr. | 89/36.02 |
| 7,779,742 | B2 | * | 8/2010 | Benyami et al. | 89/36.17 |
| 8,037,802 | B2 | * | 10/2011 | Ciriscioli et al. | 89/36.01 |
| 8,091,465 | B2 | * | 1/2012 | Ravid et al. | 89/36.08 |

(Continued)

FOREIGN PATENT DOCUMENTS

| | | | |
|---|---|---|---|
| DE | 102 41 525 | B3 | 1/2004 |
| EP | 588211 | A1 * | 3/1994 |
| EP | 1 331 466 | A2 | 7/2003 |
| EP | 2 045 566 | A2 | 4/2009 |
| WO | WO 91/12483 | A1 | 8/1991 |

OTHER PUBLICATIONS

Preliminary Search Report for French Patent Application No. 09.05887, dated Jul. 1, 2010.

*Primary Examiner* — Benjamin P Lee
(74) *Attorney, Agent, or Firm* — Oliff & Berridge, PLC

(57) ABSTRACT

An armoring element for a structure, such as a vehicle, and comprising a case integral with said structure and enclosing at least two passive or reactive armoring modules, separated by a layer of shock-absorbing material, said case containing two fixed lateral walls parallel to one another and integral with a back wall intended to be positioned on said structure, wherein said armoring modules are mounted sliding on slides integral with the lateral walls of said case, and wherein they may thus be individually introduced or removed from said case via a front opening positioned opposite said back wall and delimited by said lateral walls, stop means ensuring the retention of each of said armoring modules with respect to said lateral walls when it is put into place on said lateral walls.

10 Claims, 2 Drawing Sheets

U.S. PATENT DOCUMENTS

2007/0113730 A1* 5/2007 Benyami et al. ..... 89/36.02
2008/0083323 A1* 4/2008 Jones et al. ..... 89/36.02
2010/0095832 A1* 4/2010 Gabrys ..... 89/36.02
2010/0206158 A1* 8/2010 Neethling ..... 89/36.02

* cited by examiner

ARMORING ELEMENTS FOR A STRUCTURE, SUCH AS A MILITARY VEHICLE

BACKGROUND OF THE INVENTION

1. Field of the Invention

The technical scope of the invention is that of armoring elements for a structure, such as a military vehicle or fixed structure (command post or building).

2. Description of the Related Art

It is known to apply a passive or reactive armoring element to the wall of a structure to provide additional protection, for example against rockets or shaped-charge projectiles.

These add-on protections are mounted in the field to overcome a specific threat. They are dismounted when that specific threat is no longer present.

Known add-on armoring elements more often than not comprise a casing that is fixed to the structure and that encloses passive or reactive armoring modules.

These modules are more often than not inclined like louvered shutters with respect to the back of the casing. Such as arrangement increases the protection provided by armoring, for an equal mass, in fact the consumption of the dart by the projection of metallic plates in reactive armoring is maximal in this case.

By way of an example, patents EP-2045566 and EP-1331466 disclose such armoring elements. A problem encountered with known armoring elements is that it is not easy for an armoring module to be replaced further to its deterioration after a firing. More often than not, the whole armoring element has to be dismounted in order for its to be refurbished in a workshop. This is made even more complicated by the fact that, as described in EP-2045566, the shock-absorbing elements separating the armoring modules are in contact with the armoring modules and are sometimes fixed to one another by bonding.

An armoring element is also known by U.S. Pat. No. 3,765,299 made in the form of a parallelepipedic case provided with lateral slots in which inserts of armoring material may be inserted. However, such a case does not allow the easy replacement of the inserts in the field. Indeed, when the different cases are linked to the vehicle, and thus fixed beside one another, it is no longer possible to access the lateral slots.

SUMMARY OF THE INVENTION

The invention relates to an armoring element in which it is possible for one or several armoring elements to be replaced in the field.

Thus, the invention relates to an armoring element for a structure, such as a vehicle, and comprising a case integral with the structure and enclosing at least two passive or reactive armoring modules, separated by a layer of shock-absorbing material, the case containing two fixed lateral walls parallel to one another and integral with a back wall intended to be positioned on the structure, armoring element wherein the armoring modules are mounted sliding on slides integral with the lateral walls of the case, and wherein they may thus be individually introduced or removed from the case via a front opening, positioned opposite the back wall and delimited by the lateral walls, stop means ensuring the retention of each module with respect to the walls when it is put into place on the walls.

According to a particular embodiment, each slide is formed by at least two tabs cut into the wall in question and folded inwards with respect to the case.

According to a variant of this embodiment, each slide incorporates a first set of tabs that forms a seat for a lower face of the armoring module and a second set of tabs that forms a stop surface for an upper face of the armoring module, each module thus being held on each of its lateral walls between the two sets of tabs.

The stop means may be constituted by at least one screw or rod integral with a tab or lateral wall.

The armoring element may comprise at least one plate forming a stiffener, such plate parallel to the modules and fixed to the lateral walls.

The front opening of the armoring element may be closed by a removable cover.

The modules will be advantageously inclined with respect to a back wall of the case.

According to a variant embodiment, the armoring element will incorporate at least one passive armor plate applied to the back wall.

The layers of shock-absorbing material may comprise a material of the honeycomb type.

The layers of shock-absorbing material will advantageously be of a width that is less than that of the armoring modules so as to facilitate the sliding of the modules without their scraping on the lateral walls.

BRIEF DESCRIPTION OF THE DRAWINGS

The invention will become more apparent from the following description of a particular embodiment, such description made with reference to the appended drawings, in which.

DETAILED DESCRIPTION OF PREFERRED EMBODIMENTS

Figure 1:
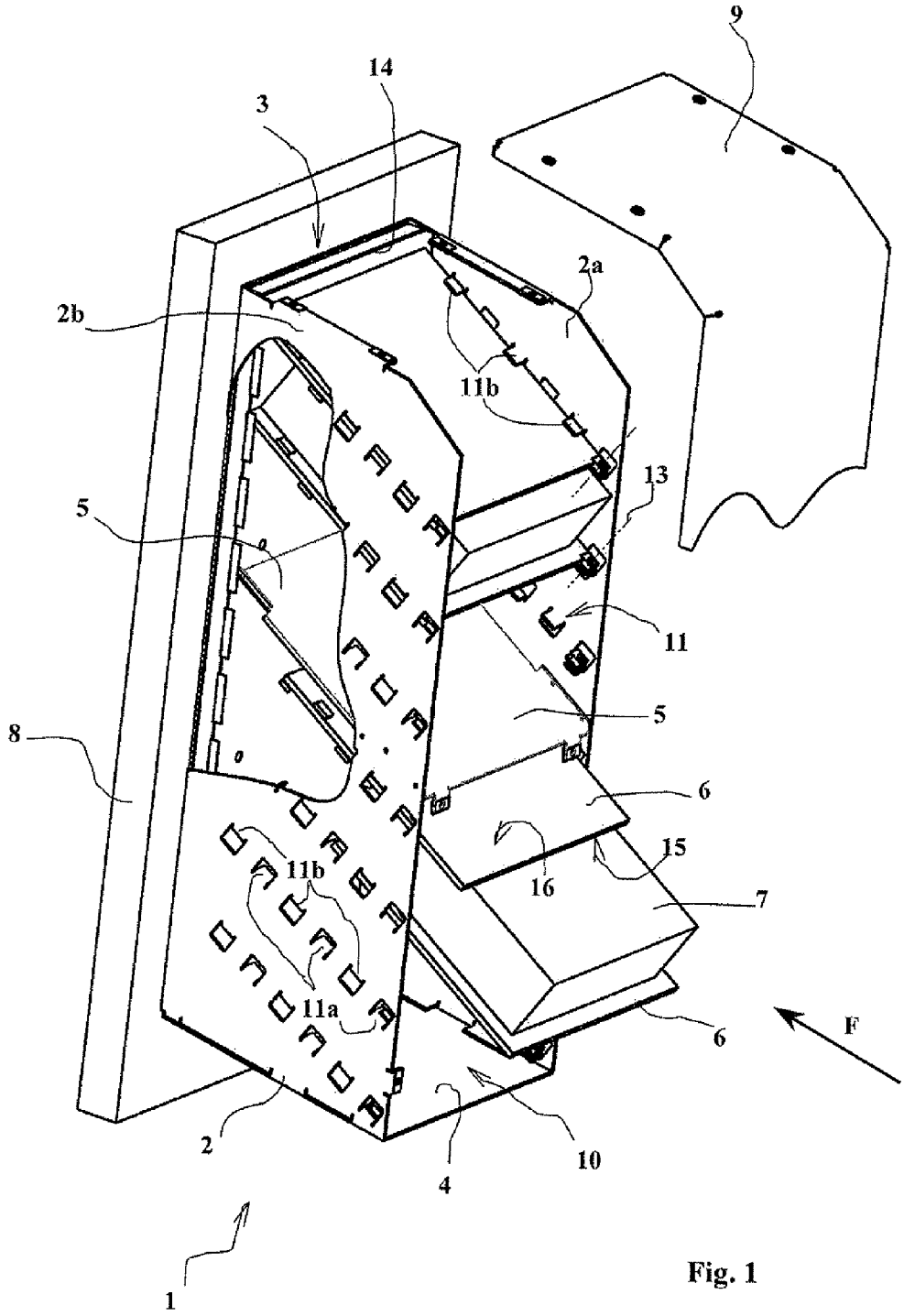
FIG. 1 shows an exploded perspective view, with partial lateral opening, of one example of an armoring element according to the invention.

With reference to FIG. 1, an armoring element 1 according to the invention comprises a case 2 made integral with a structure 8 (not shown in detail) by appropriate fixing means (not shown). The structure may be a fixed structure, such as a building, a shelter or a command post. It may also be a mobile structure, such as a vehicle.

The case 2 is substantially parallelepipedic and thus comprises two lateral walls 2*a*, 2*b* which are fixed and parallel to one another. These walls 2*a*, 2*b* are made integral with one another by a back wall 3 and a lower wall 4. The back wall 3 is intended to be positioned on the structure 8 when the case is fixed to the structure. The back wall 3 may be in direct contact with the structure 8 or be close to it, for example, positioned at a slight distance by means of spacers. The case 1 is made of folded aluminum sheeting. It also comprises at least one intermediate plate 5 made of sheet metal and forming a stiffener. This intermediate plate is fixed to the lateral walls 2*a*, 2*b*, for example, by welding.

The lateral walls 2*a*, 2*b* of the case delimit a front opening 10 positioned opposite the back wall 3 of the case.

The case 2 encloses at least two armoring modules 6 separate by a layer 7 of shock-absorbing material.

FIG. 1 shows four reactive modules 6 and two layers of shock-absorbing material 7. The two modules 6 and the layer 7 located in the upper part of the case 2 are in their functional position. The modules 6 and the layer 7 located in the lower part of the case are shown partially removed from the case 2.

As can be seen in FIG. 1, the layer 7 of shock-absorbing material is a little narrower than the armoring modules 6. Each layer of shock-absorbing material 7 is bonded to the armoring module 6 immediately below it. Layers of sock-absorbing material (not shown) will further be provided and bonded to the intermediate plate 5, on either side of the plate. These layers will thus complete the bracing of the different modules.

Figure 3:
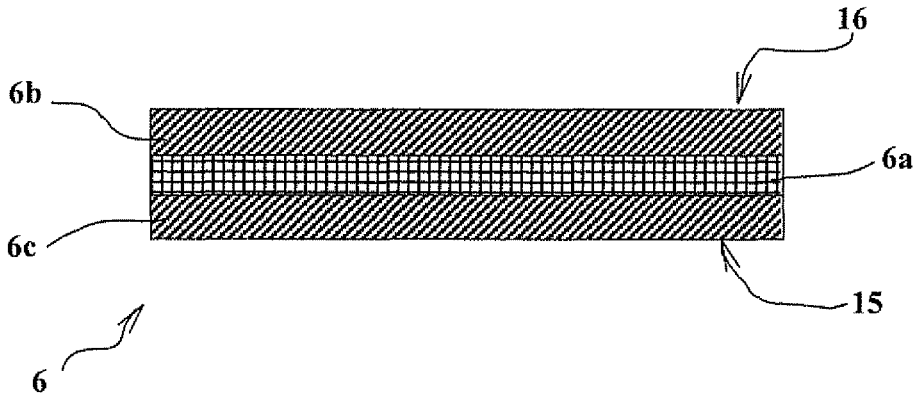
FIG. 3 is an enlarged section view of a reactive module.

The armoring modules 6 may be passive or, more advantageously, reactive. Such as shown in FIG. 3, a module 6 of the reactive type comprises a sheet of explosive 6*a* positioned between two metallic plates 6*b* and 6*c*. Reactive modules are well known to someone skilled in the art and it is therefore unnecessary to describe them in further detail here.

It is well known that, during the impacting on such o module of a dart generated by a shaped charge, the sheet of explosive 6*a* is initiated by the dart and it projects the metallic plates 6*b*, 6*c*. With such a configuration of the armoring element 1, the layers 7 of shock-absorbing material enable firstly to brace the reactive modules 6 with respect to one another and secondly to absorb the energy generated by the projection of the metallic plates 6*b* and 6*c*. The risk of propagating the reaction to adjacent reactive modules 6 is thereby reduced.

To produce the layers of shock-absorbing material 7 a low density material could be used of the honeycomb type composed of a metallic material or else a porous plastic material.

FIG. 1 shows that the armoring modules 6 are inclined with respect to the lower wall 4 (as well as with respect to the back wall 3). As has already been explained in the preamble, this inclination in a louvered style is classical. It provides an optimal effectiveness of the armoring with respect to a threat arriving from a direction F substantially parallel to the lower wall 4.

Naturally, to enable the modules to be mounted, the intermediate plate 5 is also inclined by the same angle with respect to the lower wall 4. The intermediate plate 5 is thus parallel to the modules 6.

The case 2 is closed by a cover 9 made of folded sheet metal. This cover can be dismounted and is fixed to the lateral walls 2*a*, 2*b* and to the intermediate wall 5 by screws (not shown). The cover 9 has been removed in FIG. 1.

According to one characteristic of the invention, the armoring modules 6 are mounted sliding on slides integral with the lateral walls 2*a*, 2*b* of the case 2 and inclined with respect to the back wall 3.

After the cover 9 has been removed, it is thus possible for the modules 6 to be introduced into or removed from the case 2 through the front opening 10 delimited by the lateral walls 2*a*, 2*b*. This operation can be performed easily even if several armoring elements 1 are fixed side by side on a wall. It is not necessary for the armoring element 1 to be dismounted from the vehicle to proceed with the renewal of the armoring modules 6.

It is possible to produce the slides in the form of corner stays welded to the lateral walls.

According to a particularly simple and inexpensive embodiment, each slide may be formed by at least two tabs 11, cut out of the wall 2*a*, 2*b* in question and folded inwards with respect to the case 2.

Figure 2:
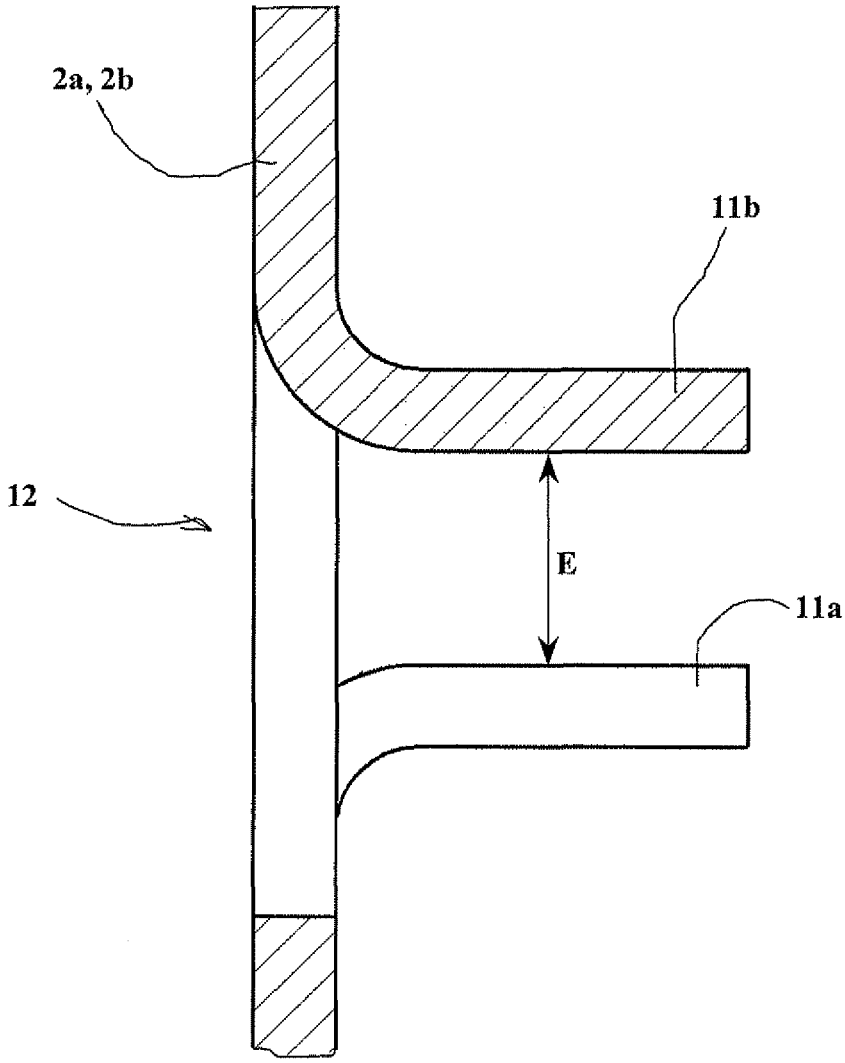
FIG. 2 is a detailed section view of one of the tabs forming a slide.

FIG. 2 shows an enlarged view of the tabs (11*a*, 11*b*). The cutting out and folding of each tab 11 leaves a hole 12 in the wall 2*a*, 2*b*. This hole acts as a deconfinement aperture enabling the gases to be evacuated when the reactive module 6 is initiated.

According to the embodiment shown in FIGS. 1 and 2, each slide is formed by two sets of tabs 11*a* and lib. A first set of tabs 11*a* forms a seat for a lower face 15 of one armoring module and a second set of tabs 11*b* forms a stop surface for an upper face 16 of the same armoring module. Thus, each module 6 is held by its lateral walls 2*a* and 2*b* against the two sets of tabs 11*a*, 11*b*.

FIG. 2 more particularly shows the direction in which the tabs 11*a* and lib are folded. The tabs lib of the second set are thus integral with the upper edge of a hole 12 whereas the tabs 11*a* of the first set are integral with the lower edge of another hole 12. There is a space E between tabs 11*a* and lib enabling the armoring module to be accommodated with functional play of some tens of millimeters enabling the armoring module 6 to be slipped onto the slides/tabs.

Armoring module 6 slides on its slides possibly carrying the layer 7 of shock-absorbing material bonded to it. The narrowest width for the layers of shock-absorbing material allows such sliding without this material being scraped on the lateral walls 2*a*, 2*b*.

Stop means further ensure that each module 6 is held with respect to the walls 2*a*, 2*b* when this module is put into place between these walls. The stop means may be constituted by at least one screw 13 (or rod) integral with a lateral wall 2*a* or 2*b* (only the axis of this screw is shown in FIG. 1). This screw or rod may also be integral with the tab 11 located the foremost. In this case, the tabs 11 will be made sufficiently long for it to be possible to position a screw in the tab whereas module 6 is resting on this tab.

Lastly, FIG. 1 shows that the armoring element 1 incorporates a passive armor plate 14 that is applied to the back wall 3. This plate completes the protection ensured by the reactive modules 6 by stopping the fragments from the plates 6*b*, 6*c* and what remains of the jet which has been disorganized by the reactive modules 6. This passive armoring may be constituted by a glass plate.

One of the advantages of the invention lies in that it is possible, to lighten the vehicle, for a certain number of modules 6 to be removed from the case 2. It is also possible for a module 6 having functioned to be easily replaced by another new module.

An armoring element 1 has been described here that is formed of several modules 6 of reactive armoring. It is possible, if the potential threat is reduced, for one or several of the reactive modules 6 (or even all) by passive modules (for example simple plates or armored steel).

What is claimed is:

1. An armoring element for a structure, comprising:

a case with two fixed lateral walls parallel to one another and integral with a back wall;

at least two passive or reactive armoring modules enclosed by the case;

a layer of shock-absorbing material separating the at least two passive or reactive armoring modules;

slides that are integral with the lateral walls of the case; and stop means, wherein:

the armoring modules are mounted sliding on the slides;

the armoring modules are individually introduced or removed from the case via a front opening positioned opposite the back wall and delimited by the lateral walls;

the stop means retain each of the armoring modules with respect to the lateral walls when each of the armoring modules is put into place on the lateral walls; and the armoring modules are inclined downward at an angle of inclination with respect to the back wall of the case toward the front opening.

2. The armoring element according to claim 1, wherein each of the slides is formed by at least two tabs cut into one of the walls and folded inwards with respect to the case.

3. The armoring element according to claim 2, wherein each of the slides incorporates a first set of tabs that forms a seat for a lower face of the armoring modules and a second set of tabs that forms a stop surface for an upper face of the armoring modules, each of the armoring modules thus being held on each of the lateral walls between the two sets of said tabs.

4. The armoring element according to claim 2, wherein the stop means are constituted by at least one screw or at least one rod integral with at least one of the tabs or with the lateral walls.

5. The armoring element according to claim 1, wherein the armoring element further comprises at least one plate forming a stiffener, the at least one plate being parallel to the armoring modules and fixed to the lateral walls.

6. The armoring element according to claim 1, wherein the opening is closed by a removable cover.

7. The armoring element according to claim 1, wherein the armoring element incorporates at least one passive armor plate applied to the back wall.

8. The armoring element according to claim 1, wherein the layers of shock-absorbing material comprise a material of the honeycomb type.

9. The armoring element according to claim 8, wherein the layers of shock-absorbing material are of a width that is less than that of the armoring modules so as to facilitate the sliding of the armoring modules without the armoring modules scraping on the lateral walls.

10. The armoring element according to claim 3, wherein the stop means are constituted by at least one screw or at least one rod integral with at least one of the tabs or with the lateral walls.

* * * * *